US011578508B2

(12) United States Patent
Promutico

(10) Patent No.: US 11,578,508 B2
(45) Date of Patent: Feb. 14, 2023

(54) DOOR-LOCKING DEVICE WITH SAFETY SYSTEM

(71) Applicant: BITRON S.P.A., Turin (IT)

(72) Inventor: Fabrizio Promutico, Turin (IT)

(73) Assignee: BITRON S.P.A., Turin (IT)

( * ) Notice: Subject to any disclaimer, the term of this patent is extended or adjusted under 35 U.S.C. 154(b) by 888 days.

(21) Appl. No.: 16/465,571

(22) PCT Filed: Nov. 23, 2017

(86) PCT No.: PCT/IT2017/000264
§ 371 (c)(1),
(2) Date: May 31, 2019

(87) PCT Pub. No.: WO2018/104974
PCT Pub. Date: Jun. 14, 2018

(65) Prior Publication Data

US 2020/0095801 A1 Mar. 26, 2020

(30) Foreign Application Priority Data

Dec. 9, 2016 (IT) ..... 102016000124504

(51) Int. Cl.
*E05B 47/02* (2006.01)
*D06F 39/14* (2006.01)
*E05B 47/00* (2006.01)

(52) U.S. Cl.
CPC ..... *E05B 47/026* (2013.01); *D06F 39/14* (2013.01); *E05B 47/0004* (2013.01);
(Continued)

(58) Field of Classification Search
CPC ..... D06F 39/14; D06F 37/42; F24C 15/022; E05B 2047/0068; Y10S 292/69
See application file for complete search history.

(56) References Cited

U.S. PATENT DOCUMENTS 5,072,974 A * 12/1991 Henne ..... F24C 15/022 292/201
5,419,305 A * 5/1995 Hanley ..... F24C 15/022 292/113
(Continued)

FOREIGN PATENT DOCUMENTS

CN 1044877 A 8/1990
CN 102041661 A 5/2011
(Continued)

OTHER PUBLICATIONS

Computer Generated Translation for KR 20080088409 A, Generated on May 20, 2022, https://worldwide.espacenet.com/ (Year: 2022).*
(Continued)

*Primary Examiner* — Alyson M Merlino
(74) *Attorney, Agent, or Firm* — Platinum Intellectual Property

(57) ABSTRACT

The present invention relates to a Door-locking device (1) for a household appliance, said household appliance being of the type comprising a door (5), said door-locking device (1) comprising an actuator (2), a blocking member (4), driven by said actuator (2), said blocking member (4) being capable of assuming a rest position and an engagement position, in which, when said door (5) is closed, said blocking member (4) engages with said door (5) holding it closed, and a switch (7), capable of assuming a first state, in which it enables the power supply to said household appliance, and a second state, in which it disables the power supply of said household appliance, characterized in that it comprises an activating assembly (3), coupled with said blocking member (4), and in that it comprises a detecting member (6) for detecting the position said door (5), movable of a relative motion with respect to said blocking member (4) of the door (5), so as to assume with respect to said
(Continued)

blocking member (4) a first position, wherein, when said blocking member (4) is in said engagement position, said activating assembly (3) interferes with said switch (7), which assumes said first state; and a second position, wherein, when said blocking member (4) is in said engagement position and said door (5) of said household appliance is open, said activating member (31) does not interfere with said switch (7) that assumes said second state.

8 Claims, 2 Drawing Sheets

(52) U.S. Cl.
CPC ..... *E05B 2047/0051* (2013.01); *E05B 2047/0068* (2013.01); *E05Y 2900/30* (2013.01)

(56) References Cited

U.S. PATENT DOCUMENTS

| | | | | |
|---|---|---|---|---|
| 6,950,033 | B1 | 9/2005 | Guyre | |
| 7,150,480 | B2 | 12/2006 | Lafrenz | |
| 7,481,469 | B2 * | 1/2009 | Harrer | F24C 15/022 292/201 |
| 9,335,056 | B1 | 5/2016 | Lomicka et al. | |
| 9,587,837 | B2 * | 3/2017 | Colucci | F24C 15/022 |
| 2004/0140677 | A1 * | 7/2004 | Hengelein | E05B 47/0009 292/201 |
| 2010/0117378 | A1 * | 5/2010 | Seo | D06F 39/14 292/163 |
| 2016/0160535 | A1 * | 6/2016 | Haidvogl | E05B 51/00 312/212 |
| 2017/0328576 | A1 * | 11/2017 | Dino | F24C 15/022 |

FOREIGN PATENT DOCUMENTS

| | | | | | |
|---|---|---|---|---|---|
| CN | 102677983 | A | | 9/2012 | |
| CN | 102984986 | A | | 3/2013 | |
| DE | 3010124 | A | * | 9/1981 | F24C 15/022 |
| DE | 102006058322 | A1 | * | 6/2008 | A47L 15/4259 |
| DE | 102015201944 | A1 | | 9/2015 | |
| EP | 0076409 | A1 | | 4/1983 | |
| EP | 1039012 | A1 | * | 9/2000 | D06F 37/42 |
| EP | 1640493 | A2 | * | 3/2006 | D06F 37/42 |
| KR | 20080088409 | A | * | 10/2008 | E05B 2047/0068 |
| KR | 20080099572 | A | * | 11/2008 | E05B 63/08 |
| WO | 2013181289 | A1 | | 12/2013 | |

OTHER PUBLICATIONS

Computer Generated Translation for KR 20090126465 A, Generated on May 20, 2022, https://worldwide.espacenet.com/ (Year: 2022).*

CNIPA first office action of the parallel Chinese application No. 2017800759517 dated Sep. 26, 2021, with English translation.

KPO first office action of the corresponding Korean patent application No. 10-2019-7019959 dated Oct. 29, 2021, with English translation.

Search report dated Jun. 20, 2017 for the Italian priority application No. 102016000124504.

* cited by examiner

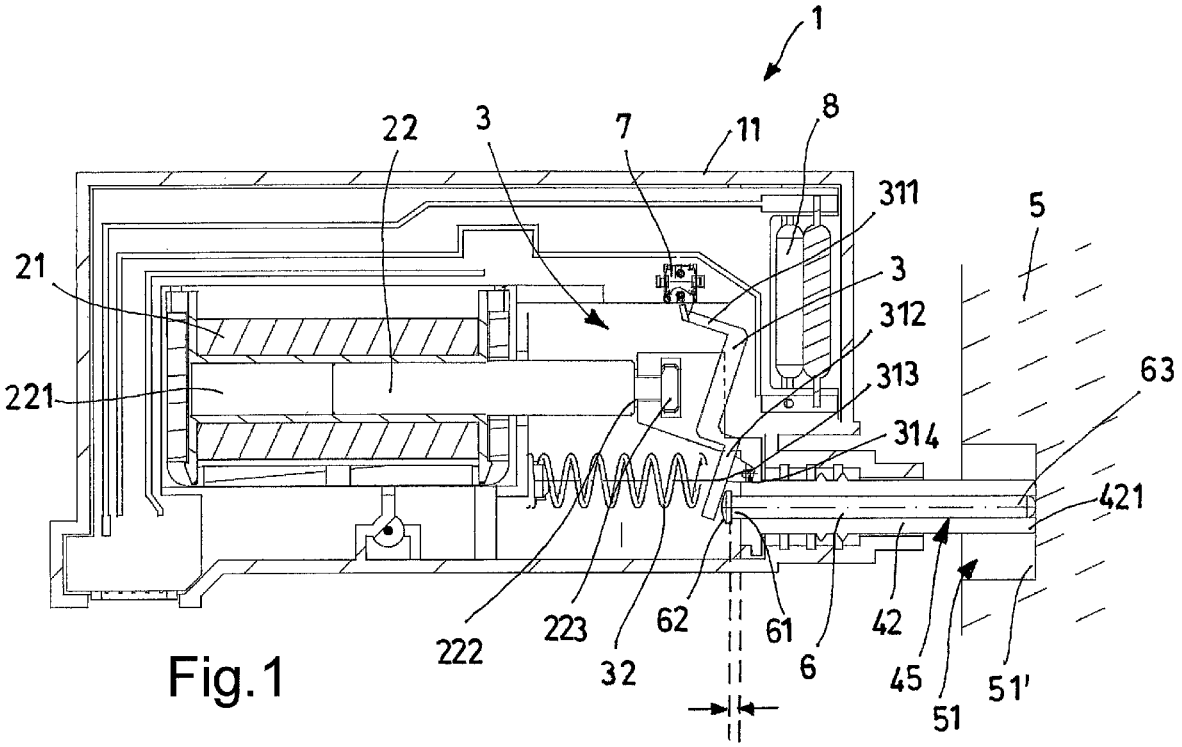
Fig.1
Fig.2
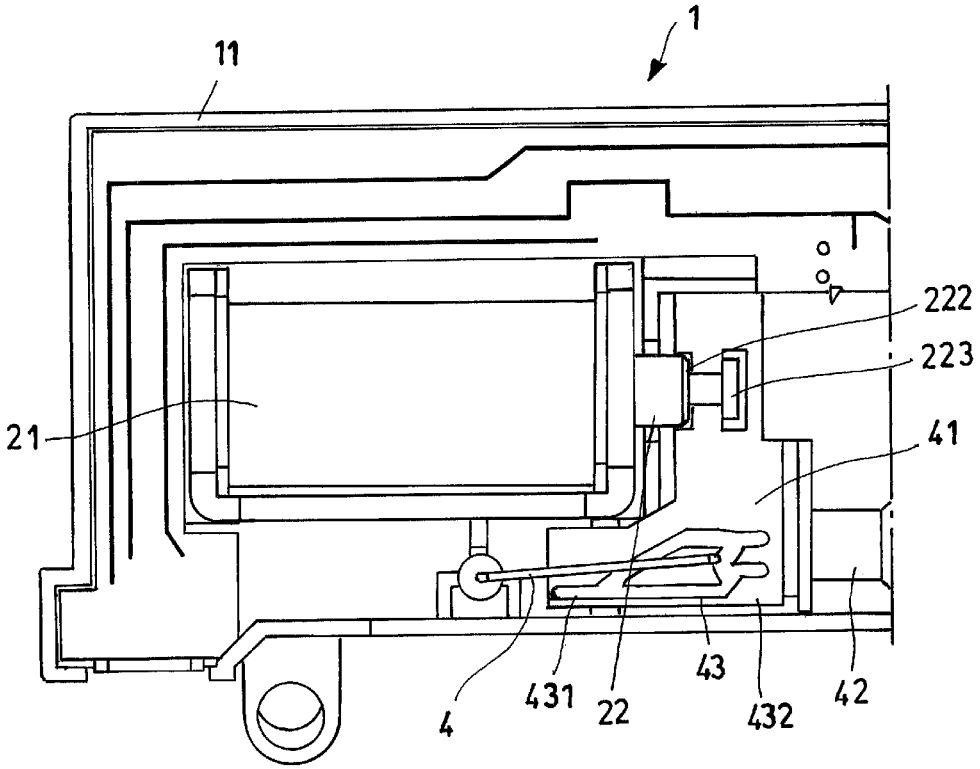

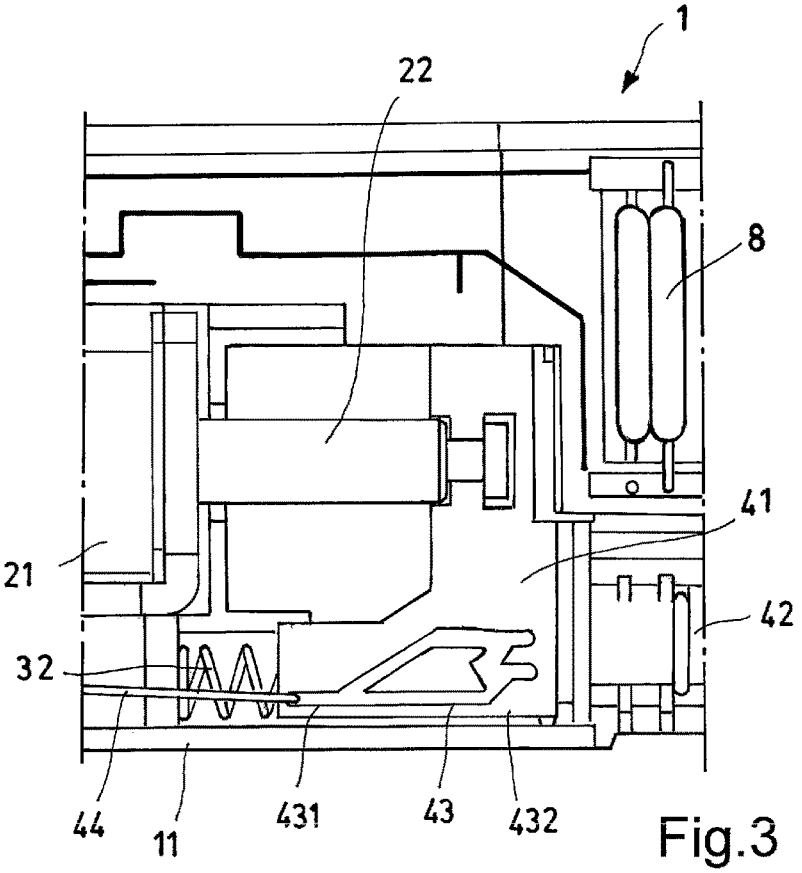
Fig.3
Fig.4
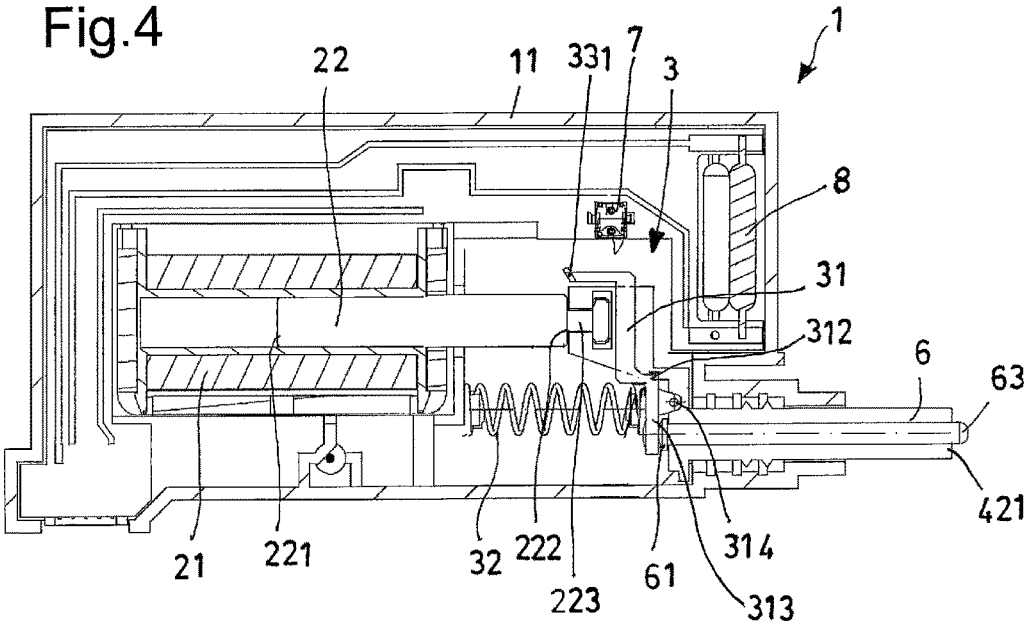

DOOR-LOCKING DEVICE WITH SAFETY SYSTEM

RELATED APPLICATIONS

This application is a United States National Stage Application filed under 35 U.S.C 371 of PCT Patent Application Serial No. PCT/IT2017/000264, filed 23 Nov. 2017, which claims ITALIAN Patent Application Serial No. 102016000124504, filed 9 Dec. 2016, the disclosure of all of which are hereby incorporated by reference in their entirety.

The present invention relates to a door-locking device with security system.

More specifically, the invention concerns a door-locking device designed and manufactured in particular for allowing the automatic detection of an open door of a household appliance.

In the following the description will be applied to a household appliance, such as a washing machine or a dryer, but it is clear that it should not be considered limited to this specific use.

As is well known, there are currently several types of door-lock devices, generally equipped with sensors to detect if the door of the household appliance is open or closed.

This detection is necessary to prevent, in case of system malfunctions, that the household appliance can be activated when the door is open.

A technical problem of the systems according to the prior art is that, in the case of malfunction of the door sensor, there would be the risk of activating the household appliance with the door itself open.

In order to overcome the limit shown, systems capable of inhibiting the activation of the household appliance when the door is open by means of the same door-lock are known.

An example of such systems is described in the U.S. Pat. No. 7,150,480 B2, which describes a single member sequentially moving according to three different positions: a first position, in which it is disengaged from the door and in which the generation of a first signal is provided, a second position, in which it is engaged with the door and in which it is provided the generation of a second signal, and a third position, in which it is disengaged from the door, in which the generation of a third signal is provided.

The system described above is very complex and requires the management of three different positions of the blocking element, with the following difficulties in managing the activation tolerances of said three electrical signals, with the possible risks of incorrect signals depending on the position taken. It is apparent that the door-lock devices according to the prior art are not totally safe.

In light of the above, it is therefore an object of the present invention to propose a door-locking device capable of overcoming the limits of those of the prior art and, in particular, which may allow the detection of the opening or closing state of the door in a simpler and a more effective way by the minimum number of positions of the blocking element, thus simplifying the tolerance chain.

Another object of the invention is that the door-lock according to the invention is technically simple and reliable.

It is therefore specific object of the present invention a door-locking device for a household appliance, said household appliance being of the type comprising a door, said door-locking device comprising an actuator, a blocking member, driven by said actuator, said blocking member being capable of assuming a rest position and an engagement position, in which, when said door is closed, said blocking member engages with said door holding it closed, and a switch, capable of assuming a first state, in which it enables the power supply to said household appliance, and a second state, in which it disables the power supply of said household appliance, characterized in that it comprises an activating assembly, coupled with said blocking member, and in that it comprises a detecting member for detecting the position said door, movable of a relative motion with respect to said blocking member of the door, so as to assume with respect to said blocking member a first position, wherein, when said blocking member is in said engagement position, said activating assembly interferes with said switch, which assumes said first state; and a second position, wherein, when said blocking member is in said engagement position and said door of said household appliance is open, said activating member does not interfere with said switch that assumes said second state.

Always according to the invention, said door may have an engagement recess, having a bottom wall, characterized in that said blocking member comprises a latch, having a free end, wherein, when said blocking member is in said engagement position, said free end of said latch is in abutment with said bottom wall.

Still according to the invention, said activating assembly may comprise a rocker arm, pivoted on said blocking member about a pin, said rocker arm having a first end and a second end, and a pushing spring, arranged so that when said blocking member is in said rest position, said pushing spring is compressed; while, when said blocking member is in said engagement position, said pushing spring exerts a force on said second end of said rocker arm.

Advantageously according to the invention, said blocking member may have a through channel and said detecting means may be inserted in said through channel and slidably movable therein, said detecting member having a length greater than said through channel and having a first end, which comprises a head, and a second end, said head being in contact with said second end of said rocker arm.

Further according to the invention, when said door is closed and said blocking member is in said engagement position, said free end of said latch and said second end of said detecting member may be in abutment with said bottom wall of said engagement recess of said door, the exceeding length of said detecting member with respect to said through channel, holds said rocker arm rotated so that said first end interferes with said switch, which assumes said first state; and when said door is open and said blocking member is in said engagement position, said second end of said detecting member does not have as abutment said bottom wall of said engagement recess of said door, the action of said pushing spring causing the rotation of said rocker arm around said pin and the further insertion of said detecting means through said through channel, so as to disengage said first end from said switch, which assumes said second state.

Always according to the invention, said device may comprise a containment enclosure, said blocking member may have a constrained path and comprise a lever, pivoted at one end to said containment casing and having at the other end a pawl, constrained to move along said constrained path, said constrained path having a first housing, in which said pawl arranges when said blocking member is in said rest position, thus holding said blocking member, overcoming the force of said pushing spring; and a second housing, in which it has said pawl when said blocking member assumes said engagement position.

Still according to the invention, according to the invention, said actuator may comprise a solenoid, a movable core sliding inside said solenoid and having a first end and a second end, said movable core being movable between a retracted position, in which it is inserted within said solenoid, and an extracted position, in which it is at least partially extracted from said solenoid.

Further according to the invention, said blocking member may be capable of assuming said rest position when said the movable core is in said retracted position and said engagement position, when said the movable core is in said extracted position.

Advantageously according to the invention, said blocking member may comprise a supporting base.

Preferably according to the invention, said movable core may comprise a pin on the second end, and said supporting base may be fixed to said coupling pin.

Always according to the invention, said constrained path may be obtained on said supporting base.

Still according to the invention, said device may comprise a magnetic sensor for detecting if said door is closed or opened, respectively enabling or disabling the power supply of said household appliance.

The present invention will be now described, for illustrative but not limitative purposes, according to its preferred embodiments, with particular reference to the figures of the enclosed drawings, wherein:

FIG. 1 shows a side section view of the door-locking device with a safety system according to the present invention in a locked position of the door of a household appliance;

FIG. 2 shows a detail of FIG. 1;

FIG. 3 shows the detail of FIG. 2 when the door-locking device is in the unlocked position; and FIG. 4 shows the door-locking device according to FIG. 1 in an open door detecting position.

In the various figures, similar parts will be indicated by the same reference numbers.

With reference to the FIGS. 1 and 2, a door-locking device 1 is observed with a security system according to the present invention.

The door-locking device 1 comprises a containment enclosure 11, in which there are essentially arranged an actuator 2, an activating assembly 3, a blocking member 4 of the door 5 of the household appliance, a detecting member 6 of the position of the door 5 and a switch 7.

Said door 5 has an engagement recess 51, having a bottom wall 51', whose function will be better defined hereafter.

Said actuator 2 comprises a solenoid 21, within which a movable core 22 is movable, having a first end 221 and a second end 222.

Said movable core 22 is movable between a retracted position, in which it is inserted in said solenoid 21, such that said first end 221 is in abutment with a bottom wall 23 of the housing, in which said solenoid 21 is arranged, and an extracted position, in which it is at least partially extracted from said solenoid 21.

Said movable core 22 has a coupling pin 223 on said second end, which function will be better defined below.

The blocking member 4 comprises a support base 41 and a latch 42 having a free end 421. Said support base 41 is fixed to said coupling pin 223. Said blocking member 4, and therefore said latch 42, is capable of assuming two positions, i.e. a rest position, when said movable core 22 is in said retracted position, and an engagement position, when said movable core 22 is in said extracted position.

In said engagement position, said latch 42 is adapted to insert, when said door 5 is closed, into said engagement recess 51, such that said free end 421 is in abutment with said bottom wall 51'.

Moreover, in said engagement position, said support base 41 of said blocking member 4 is in abutment with a wall of said containment enclosure.

Said blocking member 4 also has a constrained path 43 (like a desmodrome) obtained on said support base 41, and comprises a lever 44, pivoted at one end on said containment enclosure 11 and having a pawl 441 at the other end, constrained to move along said constrained path 43, which has a first housing 431 and a second housing 432, whose function will be better defined hereafter. Finally, said blocking member 4 has a through channel 45, whose function will be better defined hereinafter.

The activating assembly 3 comprises a rocker arm 31, pivoted on said support base 41 of said blocking member 4 around a pin 314.

Said rocker arm 31 comprises a first end 311 and a second end 312, on which a plate 313 is obtained, whose operation will be better defined below.

Said activating assembly 3 also comprises a pushing spring 32 interposed between said containment enclosure 11 and said plate 313 of said rocker arm 31. In particular, when said latch 42 is in said rest position, said pushing spring 32 is compressed; while, when said latch 42 is in said engagement position, said pushing spring 32 presses on said plate 313, or on said second end 312, of said rocker arm 31.

The detecting member 6 in the present embodiment is inserted into said through channel 44 of said blocking member 4.

Moreover, said detecting member 6 has a greater length than said through channel.

Said detecting member 6 has a first end 61, which comprises a head 62, and a second end 63.

Said detecting member 6 is arranged so that said head 63 interferes with said plate 313, namely on said second end 312, of said rocker arm 31.

In addition to the above, the door-locking device 1 also comprises a magnetic sensor 8 for detecting whether the door 5 is closed or open.

The operation of the door-locking device 1 with security system described above is as follows.

When the door 5 is open or closed, said solenoid 21 is not powered or is powered according to a suitable polarity, said movable core 22 is in said retracted position, such that said first end 221 of said movable core 22 is in contact with the bottom wall 23 of the housing, which said solenoid 21 is arranged in, said latch 42 is in said rest position and said switch 7 is open. Therefore, the household appliance cannot be activated regardless of the open or closed position of the door 5.

Moreover, the pawl 441 of said lever 44 is arranged in said first housing 431 of said constrained path 43, thus holding said support base 41 of said blocking member 4, overcoming the pushing force of said pushing spring 32 on said rocker arm 31 and therefore on said blocking member 4, which said rocker arm 31 is pivoted on.

Instead, in case of the door were closed, the magnetic sensor 8 operating detecting that the door is closed and the solenoid 21 powered with a suitable polarity, said movable core 22 would pass from said retracted position to said extracted position, causing said pawl 441 to pass from said first housing 431 to said second housing 432 (see FIG. 3) of said constrained path 43.

In this way, said latch 42 moves arranging in said engagement position, inserting itself in said engagement recess 51 and thus blocking said door 5 closed.

In this configuration, both said free end 421 of said latch 42 and said second end 63 of said detecting member 6 are abutted with said bottom wall 51' of said engagement recess 51 of said door 5.

Since said detecting member 6 is longer than the through channel 45 of said blocking member 4, the exceeding length of said detecting member 6, which is in a first operating position with respect to said blocking member 4, indicated in the FIG. 1 with d, keeps said rocker arm 31 rotated, so that said first end 311 interferes with said switch 7, enabling the operation of said household appliance. In other words, a user can activate said household appliance.

In case of the door is open and the magnetic sensor 8 does not operate, then giving a closed door false signal, if a user activates the household appliance, the solenoid 21 would be powered with a suitable polarity, said movable core 22 would pass from said retracted position to said extracted position, by passing said pawl 441 from said first housing 431 to said second housing 432 of said constrained path 43.

In this way, said latch 42 would move arranging in said engagement position, although in this case it would obviously not be inserted into said engagement recess 51, being said door 5 open.

In this configuration, however, as it can be seen in FIG. 4, said second end 63 of said detecting member 6 would not find the bottom wall 51' of said engagement recess 51 of said door 5.

Therefore, the action of said pushing spring 32 would cause said rocker arm 31 to rotate about said pin 314 according to the arrow A and the further insertion of said detecting member 6 through said through channel 45, until the end of said head 62 on said support base 41, so as to move into said second operating position.

Due to said rotation, the first end 311 of said rocker arm disengages from said switch 7, thus disabling the household appliance, which could not be activated by the user.

An advantage of the door-locking device according to the present invention is that of allowing a high degree security of the system, allowing to detect in any case the opening of the household appliance door even in case of malfunction of the sensor intended to detect the position of said door.

The present invention has been described for illustrative but not limitative purposes, according to its preferred embodiments, but it is to be understood that modifications and/or changes can be introduced by those skilled in the art without departing from the relevant scope as defined in the enclosed claims.

The invention claimed is:

1. A door-locking device for a household appliance, said household appliance comprising a door, said door-locking device comprising an actuator; a blocking member, driven by said actuator, said blocking member being capable of assuming a rest position and an engagement position, in which, when said door is closed, said blocking member engages with said door; a switch, capable of assuming a first state, in which the switch enables a power supply to said household appliance, and a second state, in which the switch disables the power supply to said household appliance; an activating assembly, coupled with said blocking member, the activating assembly comprising a rocker arm, rotatable on said blocking member about a pin, said rocker arm having a first end and a second end, and a pushing spring, arranged so that when said blocking member is in said rest position, said pushing spring is compressed and said blocking member is in said engagement position, said pushing spring exerts a force on said second end of said rocker arm; a detecting member for detecting the position of said door, the detecting member being movable relative to said blocking member, so as to assume, with respect to said blocking member, a first position, when said blocking member is in said engagement position, said detecting member is in said first position, and said door is closed, said activating assembly interferes with said switch, such that said switch assumes said first state; and when said blocking member is in said engagement position, said detecting member is in a second position, and said door is open, said activating assembly does not interfere with said switch, such that said switch assumes said second state; a containment enclosure; and a lever, wherein said blocking member has a constrained path, wherein said lever is pivoted at one end to said containment enclosure and has, at another end, a pawl constrained to move along said constrained path of said blocking member, said constrained path having a first portion, in which said pawl is arranged when said blocking member is in said rest position, thus holding said blocking member in said rest position and overcoming a force of said pushing spring, and a second portion, in which said pawl is arranged when said blocking member assumes the engagement position, and wherein said constrained path is located on a supporting base of said blocking member.

2. The door-locking device according to claim 1, wherein said door has an engagement recess with a bottom wall, wherein said blocking member comprises a latch, having a free end, such that when said blocking member is in said engagement position, said free end of said latch is in abutment with said bottom wall.

3. The door-locking device according to claim 2, wherein when said door is closed and said blocking member is in said engagement position, said free end of said latch and a second end of said detecting member are in abutment with said bottom wall of said engagement recess of said door, a length of said detecting member exceeds a length of a through channel of the blocking member, in which said detecting member is located for movement, such that a first end of said detecting member extends from said through channel so as to hold the rocker arm of said activating assembly in a rotated position so that the first end of said rocker arm interferes with said switch, thereby causing said switch to assume said first state; and when said door is open and said blocking member is in said engagement position, said second end of said detecting member is not in abutment with said bottom wall of said engagement recess of said door, such that said detecting member does not extend from said through channel to hold said rocker arm in said rotated position, thereby an action of the pushing spring causes said rocker arm to rotate about the pin, so as to disengage said first end of said rocker arm from said switch and cause said switch to assume said second state.

4. The door-locking device according to claim 1, wherein said blocking member has a through channel, and said detecting member is located in said through channel and slidably movable therein, said detecting member having a length greater than said through channel and having a first end, which comprises a head, and a second end, said head being in contact with said second end of said rocker arm.

5. The door-locking device according to claim 1, wherein said actuator comprises:

a solenoid, a movable core sliding inside said solenoid and having a first end and a second end, said movable core being movable between a retracted position, in which said movable core is located within said solenoid, and an extracted position, in which said movable core is at least partially extracted from said solenoid.

6. The door-locking device according to claim 5, wherein said blocking member is capable of assuming said rest position when said movable core is in the retracted position, and is capable of assuming said engagement position when said movable core is in said extracted position.

7. The door-locking device according to claim 5, wherein said movable core comprises a coupling pin on the second end, and wherein the supporting base of said blocking member is fixed to said coupling pin.

8. The door-locking device according to claim 1, further comprising a magnetic sensor for detecting when said door is closed or opened, respectively capable of enabling or disabling the power supply to said household appliance.

* * * * *